United States Patent [19]

Chaplar

[11] Patent Number: 4,469,093

[45] Date of Patent: Sep. 4, 1984

[54] RELAXING MASSAGER

[75] Inventor: Charles Chaplar, El Paso, Fla.

[73] Assignee: Christiana Optical Company, Naples, Fla.

[21] Appl. No.: 377,672

[22] Filed: May 12, 1982

[51] Int. Cl.[3] ..... A61H 7/00

[52] U.S. Cl. ..... 128/52; 128/60

[58] Field of Search ..... 128/44, 52, 53, 51, 128/59, 60, 61; 272/73

[56] References Cited

U.S. PATENT DOCUMENTS

| | | | |
|---|---|---|---|
| 1,276,526 | 8/1918 | Hardy et al. | 128/52 |
| 1,375,652 | 4/1921 | Carlotti | 128/52 |
| 3,298,363 | 1/1967 | Parkin | 128/52 |
| 3,483,862 | 12/1962 | Takeuchi | 128/60 |
| 3,774,598 | 11/1973 | Wilson et al. | 128/52 |
| 4,058,738 | 4/1978 | Kodera | 128/52 X |
| 4,359,937 | 11/1982 | Helinski | 101/93.09 |

*Primary Examiner*—Richard J. Apley
*Assistant Examiner*—David J. Brown
*Attorney, Agent, or Firm*—Don E. Ferrell

[57] ABSTRACT

An improved massage table is provided by an arrangement of driving cams which cooperate with followers in the form of lifter bars, such bars serving to reciprocably actuate lift rods positioned through bearing guides attached to the table. Massaging members are attached to topmost portions of the lift rods and operate to bear upwardly against a cushion member in response to an upward movement of the associated lift rods so as to provide a massaging action to a person reclining on the cushion member. The driving cams are operably secured to a pair of orthogonally positioned rotating shafts, each shaft having its own driving gear ratio motor.

9 Claims, 4 Drawing Figures

RELAXING MASSAGER

BACKGROUND OF THE INVENTION

1. Field of the Invention

The present invention relates to new and useful improvements in massage tables and more particularly pertains to a new and improved massage table which includes the use of cam driven force applicators wherein lifter bars are positioned between the cam members and lift rods associated with the applicators, thereby to effect a desired massaging action to a person reclining on the table.

2. Description of the Prior Art

The use of massage tables which include the use of automatic massage applicators for achieving a desired massaging action is well known in the art. In this respect, reference is made to U.S. Pat. No. 3,464,406, which issued to Kunce on Sept. 2, 1969, wherein there is disclosed a therapeutic couch having a soft, flexible pad adapted to receive a human body in repose. The pad is supported by a series of spaced, transverse, rotatable, elongated eccentric members which, upon simultaneous rotation serially in opposite directions from a central drive member, impart an undulating, wave-like massaging action to a body. While being effective in performing its desired function, the Kunce couch is of a complex and uneconomical construction inasmuch as the eccentric members are gear driven, each of such members having gears attached thereto while at least two additional gears are required between each of such members to effect the desired counter rotation. Such a construction can also be subject to maintenance problems due to the large number of gears utilized and the power required by the driving motor to effect the desired rotation thereof.

There has been at least one attempt to develop a physiotherapy apparatus which utilizes cam driven reciprocable manipulating members in combination with a massage table. In this respect, reference is made to U.S. Pat. No. 3,298,363, which issued to Parkin on Jan. 17, 1967, wherein there is disclosed a massage table that includes manipulating members secured to reciprocable rods, with such rods being reciprocable in response to the rotation of cams in contact with bearing members on bottommost portions of the rods. However, the Parkin apparatus is also of a complicated and uneconomical construction inasmuch as the same utilizes a complex and bulky toggle mechanism to effect the transfer of motion from the cams to the manipulating members. As such, it can be appreciated that there exists a continuing need in the art for new and improved massage tables which are of a simple and economical construction and in this respect, the present invention substantially fulfills this need.

SUMMARY OF THE INVENTION

The general purpose of the present invention, which will be described subsequently in greater detail, is to provide a new and improved massage table which has all the advantages of the prior art massage tables and none of the disadvantages. To attain this, the present invention utilizes massagers fixedly secured to vertically movable lift rods and being positionable proximate to and beneath a mattress-like surface upon which a person may recline. The lift rods are guidingly-positioned within lift guides which also serve as bearing surfaces for the lift rods, thereby to facilitate their vertical up-and-down movement, while the lowermost portions of the lift rods freely rest upon lifter bars that are pivotally connected to a sidemost portion of the massage table assembly. While the lift rods are positioned upon a topmost portion of the lifter bars, the bottommost portion of the lifter bars rest upon the peripheral edges of rotatable cams, whereby a rotation of such cams effect a pivotable movement of the lifter bars that in turn translates to a vertical up-and-down movement of the associated lift rods. One or more gear ratio motors may be employed to drive rotatable shafts upon which the cams are mounted to facilitate the use of the table as desired. It is therefore an object of the present invention to provide a new and improved massage table that has all of the advantages of the prior art massage tables and none of the disadvantages.

It is another object of the present invention to provide a new and improved massage table which may be easily and efficiently manufactured.

It is a further object of the present invention to provide a new and improved massage table which is efficient and reliable in its operation.

Even another object of the present invention is to provide a new and improved massage table which of a durable and rugged construction.

Still another object of the present invention is to provide a new and improved massage table which is easy to use and which may be easily repaired in case of a malfunction.

Yet another object of the present invention is to provide a new and improved massage table which is of a portable and lightweight construction thereby to facilitate its transportation and storage as desired.

An even further object of the present invention is to provide a new and improved massage table that utilizes massagers which move in a vertically-oriented direction.

Yet even another object of the preseent invention is to obtain a new and improved massage table that is of a simple mechanical construction susceptible of a low cost of manufacture with regard to both parts and labor, and which accordingly is then susceptible of low prices of sale to the consuming public, thereby making such device economically available to the buying public.

Still yet another object of the present invention is to provide a new and improved massage table which provides in the apparatus of the prior art some of the advantages thereof, while simultaneously overcoming some of the disadvantages normally associated therewith.

These together with other objects of the invention, along with various features of novelty which characterize the invention, are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
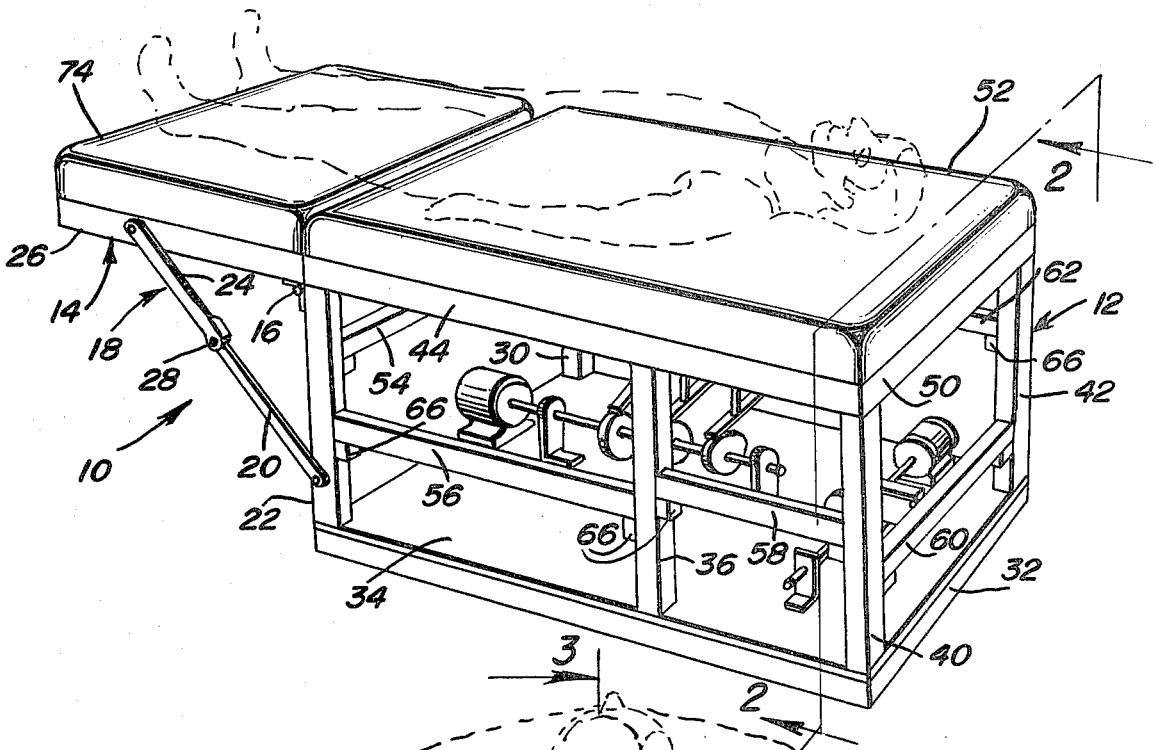
FIG. 1 is a perspective view of the new and improved massage table forming the present invention.

With reference now to the drawings and in particular to FIG. 1 thereof, a new and improved massage table embodying the principles and concepts of the present invention and generally designated by the reference numeral 10 will be described in detail. In this respect, it can be seen that the massage table 10 includes a main frame portion 12 and an end frame portion 14 pivotally attached thereto. More particularly, the end frame portion 14 is pivotally connected to the main frame portion 12 by a conventional hinge assembly 16 whereby the end frame portion may be dropped downwardly, if desired, into an abutting relationship with an end of the massage table 10 so as to facilitate the transporting or storing of the table, as well as its compactness in those situations where insufficient room exists for the use of an extended table. When the end frame portion 14 is in its extended or up position, one or more collapsible support arms 18 may be employed to maintain the end frame portion in a locked extended position, such arms consisting of a first support member 20 pivotally attached to a vertical end stanchion 22 forming a part of the massage table 10, and a second support member 24 pivotally attached to a horizontal support member 26 forming a part of the end frame portion 14. The first and second support members 20, 24, respectively, are pivotally connected together by a pin 28. While only one support arm 18 is particularly illustrated in FIG. 1, it is to be understood that a second support arm of a similar and analogous construction is pivotally connected to a second vertical end stanchion 30, as well as to the end frame portion 14, thereby to add further support to the end frame portion when the same is in its extended or up position.

Figure 2:
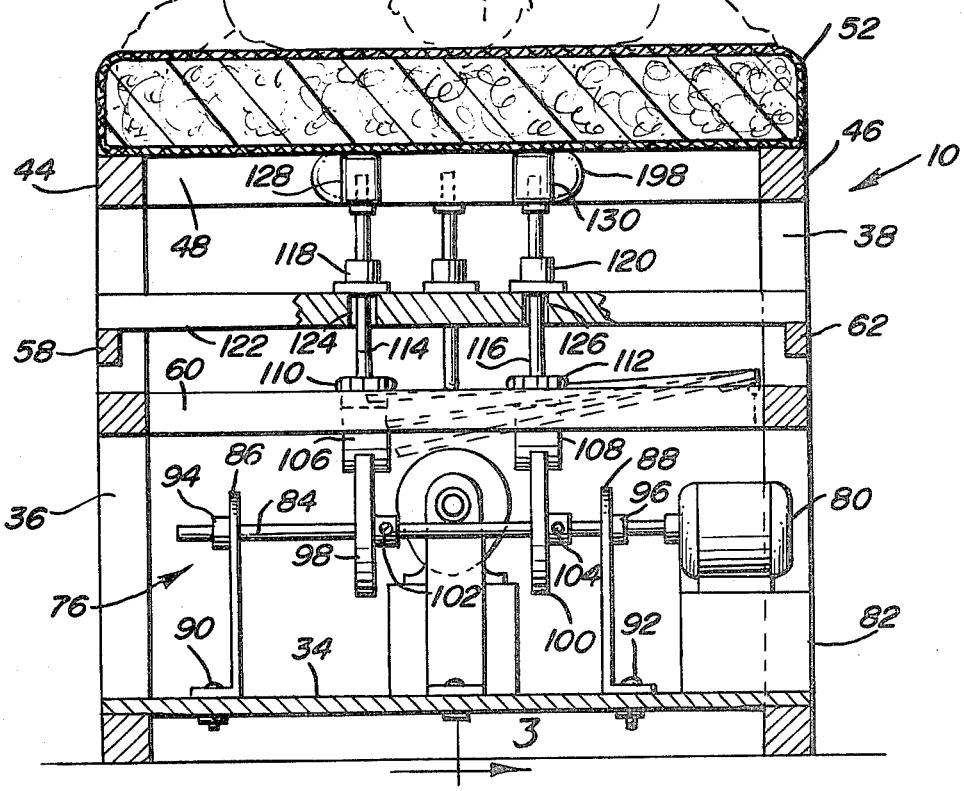
FIG. 2 is a cross-sectional end view of the present invention taken along the line 2—2 in FIG. 1.

With reference to FIGS. 1 and 2 of the drawings concurrently, it can be seen that the main frame portion 12 may typically include a ground contacting portion 32 which is of a rectangular construction and which may include a cover plate 34 positioned thereover so as to serve as a support surface for the various stanchions and motors associated with the massage table 10 and yet to be described. In this regard, the construction of the main frame portion 12 includes the aforementioned vertical support stanchions 22, 30, as well as four additional vertical supports stanchion 36, 38, 40 and 42. A pair of horizontally extending support members 44, 46 are respectively fixedly secured to the uppermost end portions of the vertical stanchions 22, 36, 40 and 30, 38, 42, while a pair of transversely extending support members 48, 50 are respectively fixedly secured to the uppermost ends of vertical stanchions 22, 30 and 40, 42. As such, a substantially rectangular frame is formed on the uppermost ends of the vertical support stanchions 22, 30, 36, 38, 40, 42 by the horizontally extending support members 44, 46 and the transversely extending support members 48, 50, thereby to form a support surface for a first mattress 52. Of course, it is to be understood that any type of human-supporting surface or mat could be employed in lieu of the mattress 52, as long as such support surface was of a somewhat flexible construction to facilitate a massaging action as yet to be described below.

Figure 3:
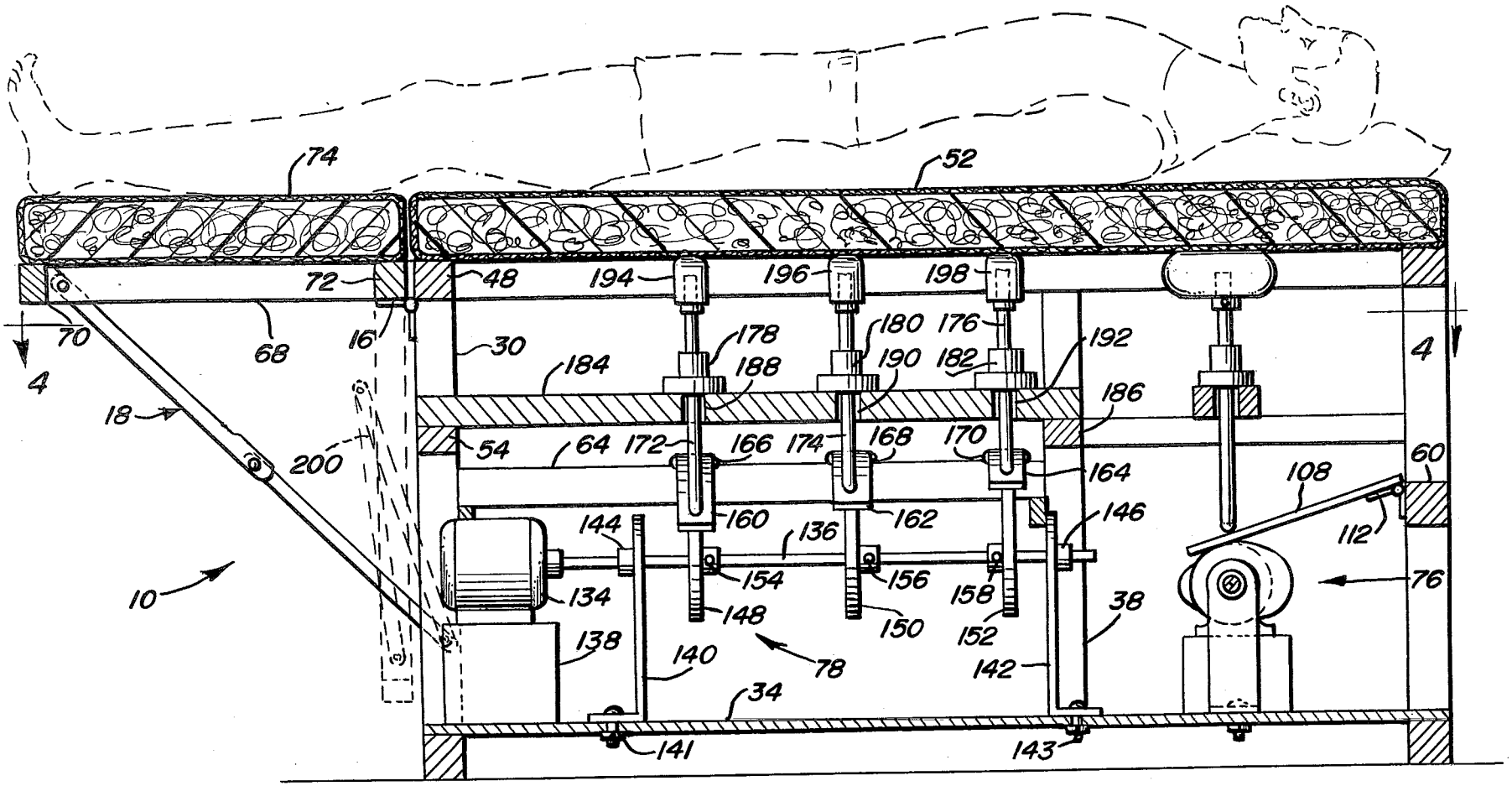
FIG. 3 is a cross-sectional side elevation view of the present invention taken along the line 3—3 in FIG. 2.

With further reference to FIGS. 1 and 2 of the drawings, along with FIG. 3 thereof, it can be seen that additional support and strength in the main frame portion 12 of the massage table 10 can be achieved through the use of a plurality of intermediately positioned support members 54, 56, 58, 60, 62 and 64. More specifically, the vertical stanchions 22 and 36 may have support blocks 66 fixedly secured to opposed facing portions thereof whereby one of the support members 56 may be supported thereby while being fixedly secured to the vertical support stanchions. By the same token, a pair of support blocks 66 may be respectively positioned on opposed facing surfaces of the vertical support stanchions 36 and 40, so as to facilitate the positioning and support of the support member 58 which may then be fixedly secured between these two vertical support stanchions. Similarly, the support member 60 is fixedly secured between the vertical support stanchions 40 and 42, the support member 62 is fixedly secured between the vertical support stanchions 42 and 38, the support member 64 is fixedly secured between the vertical support stanchions 38 and 30, and the support member 54 is fixedly secured between the vertical support stanchions 22 and 30. Of course, additional support blocks 66 are used in conjunction with these remaining support members 60, 62, 64 and 54 to thereby facilitate their positioning and support with respect to their associated vertical support stanchions 40, 42, 38, 30 and 22, respectively.

Figure 4:
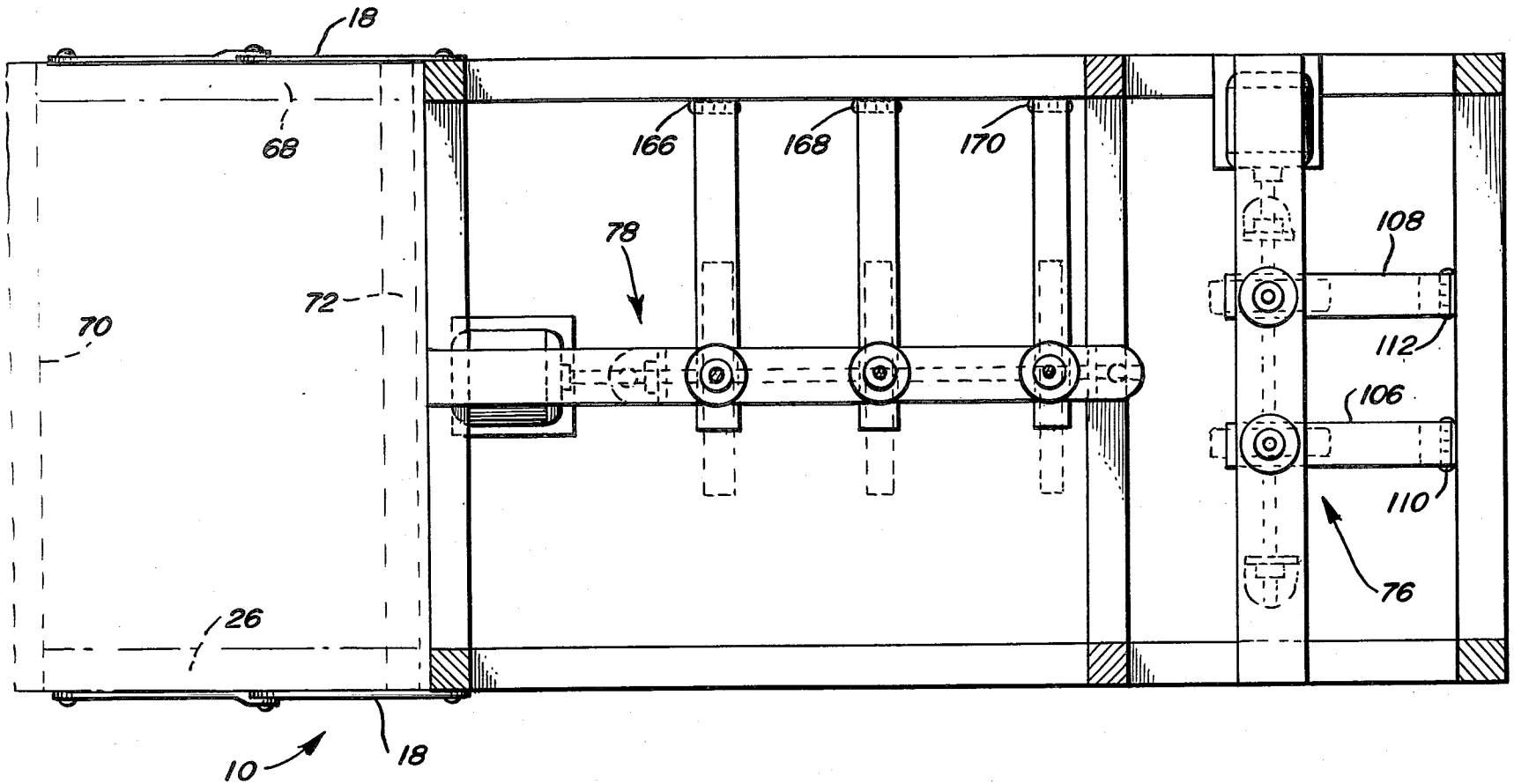
FIG. 4 is a cross-sectional top plan view of the present invention taken along the line 4—4 in FIG. 3.

Referencing FIG. 4 concurrently with FIGS. 1–3, it will be noted that the end frame portion 14 may be of a construction similar to the main frame portion 12, to include a pair of horizontally extending support members 26, 68 fixedly secured to a pair of transversely extending support members 70, 72, thereby to form a support surface for a second mattress or similar human-supporting structure 74. Of course, as best shown in FIG. 3, the aforementioned hinge assembly 16 may have its opposed pivotal faces selectively, fixedly secured between the support member 72 and the support members 22, 30, respectively associated with the end and main frame portions 14, 12.

With further reference to FIGS. 1–4 of the drawings, it can be seen that the massage table 10 also includes a first massaging means or assembly 76 positioned transversely across the support surface or cover plate 34 of the massage table and a second massaging means or assembly 78 positioned longitudinally along the cover plate 34.

With respect to the construction of the first massaging assembly 76, it will be noted that the same includes a gear ratio motor 80 fixedly mounted to a support block 82 which in turn is fixedly secured to the cover plate 34. The support block 82 serves the function of positioning the gear ratio motor 80 at a selected height above the cover plate 34 whereby a rotatable shaft 84 may be selectively mounted through a pair of bearing supports 86, 88. In this regard, the motor 80 provides the driving power to the shaft 84, whereby the same may be selectively rotated at a desired speed, while the bearing supports 86, 88 are respectively mounted to the cover plate 34 by conventional attachment means, such as nut and bolt assemblies 90, 92, respectively, and serve to permit a rotation of the shaft 84 while at the same time rigidly supporting the same at a desired distance above the cover plate 34. To facilitate this function, the bearing supports 86, 88 may be provided with respective annularly-shaped journal bearings 94, 96 fixedly secured thereto.

Inasmuch as the bearing supports 86, 88 are spaced a desired distance apart, as best illustrated in FIG. 2, it will be noted that a pair of cams 98, 100 may be selectively positioned on the shaft 84 and may then be fixedly secured in position thereon through the use of conventional attachment means, such as set screws 102, 104, respectively.

The cams 98, 100, are in sliding contact with a pair of lifter bars 106, 108, respectively, with such lifter bars being pivotally conventionally attached to the support member 60 by any known means, such as by respective hinge assemblies 110, 112. The lifter bars 106, 108 serve as followers between the outer peripheral edges of the respective cams 98, 100 and respective lift rods 114, 116. In this respect, the cams 98, 100 bear on bottommost surfaces of the respective lifter bars 106, 108 to effectively pivot the same relative to the support member 60, while such movement of the lifter bars 106, 108 is then translated to the respective lift rods 114, 116, inasmuch as these lift rods are in an abutting relationship with topmost portions of the respective lifter bars. The lift rods 114, 116 are freely reciprocable through respective lift guides 118, 120, such guides being provided with internal annularly-shaped bearing surfaces to permit such reciprocable movement of the lift rods while at the same time preventing lateral displacement. In this regard, the lift guides 118, 120 are mounted to a cross extending support member 122, such support member being fixedly secured to and extending between the longitudinally extending support members 58, 62. Of course, a pair of apertures 124, 126 are provided in a vertical direction through the cross support member 122, whereby the lift guides 118, 120 may be respectively aligned with the apertures 124, 126 to provide the needed guide channels for the respective lift rods 114, 116.

Fixedly secured to topmost portions of the lift rods 114, 116 are a pair of massaging members 128, 130. The massaging members 128, 130 may be of either a rigid or flexible construction as desired, as long as the same are capable of imparting a sufficient massaging force to the mattress 52, whereby a person reclining upon the mattress will be able to experience a massaging action through the mattress in response to a reciprocation of the lift rods 114, 116. The massaging members 128, 130 may be fixedly secured to the topmost portions of the lift rods 114, 116 in any conventional manner, such as by a threaded attachment thereto.

With respect to the construction of the second massage assembly 78, it can be seen, with particular reference to FIG. 3, that this assembly may also include a gear ratio motor 134 for supplying driving power to a rotatable shaft 136 and being fixedly mounted to a support block 138 which in turn is fixedly secured to the cover plate 34. As with the first massage assembly 76, the rotatable shaft 136 is supported between a pair of bearing supports 140, 142. The bearing supports 140, 142 are provided with respective journal members 144, 146 through which the shaft 136 is journaled, thereby to permit its rotatable movement, and the supports per se are respectively fixedly secured to the cover plate 34 through the use of nut and bolt assemblies 141, 143, respectively.

With further reference to FIGS. 1–4 of the drawings, it will be noted that the second massage assembly 78 further includes a plurality of cams 148, 150, 152 selectively positioned on the rotatable shaft 136 and being fixedly secured thereto by any conventional attachment means, such as respective set screws 154, 156 and 158. As shown, the cams 148, 150, 152 are in sliding following contact with lifter bars or followers 160, 162, 164, respectively, such lifter bars being pivotally attached to the longitudinally-extending support member 64 by any conventional means, such as by respective hinge assemblies 166, 168, 170. As such, the lifter bars or followers 160, 162, 164 are freely pivotal with respect to the longitudinally-extending support member 64 so as to follow the circumferential surface of the respective cams 148, 150, 152 during their rotation in conjunction with a rotation of the shaft 136, thereby to impart a reciprocable motion to a plurality of lift rods 172, 174, 176, respectively positioned on topmost portions of the lifter bars 160, 162, 164. As best shown in FIG. 3, the lift rods 172, 174, 176 are respectively bearingly guided in their reciprocable movement by lift guides 178, 180, 182. In this regard, the lift guides 178, 180, 182 are fixedly secured to a longitudinally-extending support member 184 which in turn is fixedly secured to the main frame portion 12 by having its one end fixedly attached to a cross extending support member 186 and having its other end fixedly attached to the cross extending support member 54. The cross extending support member 186 has its respective ends fixedly attached to the vertical support stanchions 36 and 38. Additionally, the lift guides 178, 180, 182 are concentrically aligned with a plurality of respective apertures 188, 190 and 192 vertically directed through the support member 184 so as to provide the necessary guide channels for the respective lift rods 172, 174, 176. Fixedly secured to topmost portions of the lift rods 172, 174 and 176 are respective massaging members 194, 196 and 198, such massaging members being of either a rigid or flexible construction, as desired, as long as sufficient force may be imparted to the mattress 52 to effect the desired massaging action on an individual reclining thereon, and further, the massaging members 194, 196, 198 may be of any desired shape to effect such a massaging action. Typically, such a shape would be of a longitudinal construction whereby the massaging members 194, 196, 198 would lie transverse to the longitudinal axis of the mattress 52 and such massaging members may be fixedly secured to the respective lift rods 172, 174, 176 by any conventional means, such as by a threaded attachment.

In operation, it can be seen that the massaging table 10 may have its end frame portion 14 in either its extended position as shown in FIG. 3, or in its collapsed position as designated by the reference numeral 200 also in FIG. 3. Normally, it would be expected that the end frame portion 14 would be in its extended position so as to accommodate the full length of an individual reclining upon the massage table 10. Where it is desired to accomplish a massaging action on the upper torso portion of an individual's body, the expeditious use of the first massaging assembly 76 may be employed whereby the gear ratio motor 80 may be activated to effect a rotation of the shaft 84 in its journal supports 94, 96. Inasmuch as the cams 98, 100 rotate concurrently with the shaft 84, the cams cause the lifter bars or followers 106, 108 to pivot about their respective hinge assemblies 110, 112, while at the same time imparting a reciprocable motion to the lift rods 114, 116, respectively. Of course, the reciprocable motion of the lift rods 114, 116 is translated to the massaging members 128, 130 which then bears with varying degrees of force against a bottommost portion of the mattress 52, such force being delivered through the mattress to the upper torso portion of the individual reclining thereon. Further, inasmuch as the lifter bars 106, 108 are individually and respectively controlled in their pivotal movement by the cams 98, 100, it can be seen that the shapes of the cams 98, 100 may be varied as desired so as to cause a disproportionate movement of the lift rods 114, 116 with respect to each other, thereby to effect a wobbling, as well as a reciprocable or vertical, movement of the mattress 52. Additionally, this wobbling effect of the massaging members 128, 130 may be adjustably varied through a repositioning of the individual cams 98, 100 on the rotatable shaft 84 simply be releasing the respective set screws 102, 104 to effect a repositioning of the cam and then retightening the screws.

To effect a massaging action on the lower torso portion of an individual reclining upon the massage table 10, the second massage assembly 78 may be employed. As shown, a pivotable movement of the lifter bars 160, 162, 164 is effected in response to a rotation of the respective cams 148, 150, 152 fixedly secured to the shaft 136. The pivotable movement of the lifter bars 160, 162, 164 with respect to the support member 64 effects a reciprocable movement of the lift rods 172, 174 and 176 through their respective lift guides 178, 180 and 182. As such, the massaging members 194, 196 and 198 bear with varying degrees of force along a bottommost portion of the mattress 52 so as to effect a desired massaging action on the individual reclining thereon. The relative positioning and movement of the massaging members 194, 196 and 198 with respect to one another can be varied through the selective adjustment and repositioning of the respective cams 148, 150 and 152 on the rotatable shaft 136. In this respect, the set screws 154, 156 and 158 may be released to permit the selective repositioning of the respective cams 148, 150, 152, and then may be retightened to lock the cams in position on the shaft 136. As such, the lift rods 172, 174, 176 can have their relative movement with respect to one another varied substantially which in turn substantially alters the type of massaging action imparted to an individual reclining on the mattress 52.

Of course, it is to be realized that any number of massage assemblies could be employed on a single massage table, and such assemblies could be utilized independently of one another. In other words, the first or second massage assemblies could be utilized independently of one another whereby only the upper or lower torsos of an individual may be massaged as desired.

With respect to the above description then, it is to be realized that the optimum dimensional relationships for the the invention, to include variations in size, shape, form, function and manner of operation, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new and desired to be secured by Letters Patent of the United States is as follows:

1. A massage table comprising:

frame support means; and massaging means supported by said frame support means and including massage assembly means, said massage assembly means including massaging member means for effecting a massaging action to an individual reclining on said massage table, cam means for effecting a desired movement of said massaging member means, and follower means for transmitting said movement between said massaging member means and said cam means, said follower means comprising lifter bar means, said lifter bar means being pivotally attached to said frame support means.

2. The massage table as defined in claim 1, wherein said lifter bar means is positionable between said massaging member means and said cam means, whereby a movement of said cam means effects concurrent movement of said lifter bar means and said massaging member means.

3. The massage table as defined in claim 1, wherein said massage assembly means includes first massaging action means and second massaging action means, said first massaging action means including first massaging member means, first cam means and first follower means associated therewith, and said second massaging action means including second massaging member means, second cam means and second follower means associated therewith.

4. The massage table as defined in claim 3, wherein said first follower means associated with said first massaging action means includes the use of first lifter bar means positionable between said first massaging member means and said first cam means, whereby a movement of said first cam means effects a concurrent movement of said first lifter bar means and said first massaging member means.

5. The massage table as defined in claim 3, wherein said second follower means associated with said second massaging action means includes the use of second lifter bar means positionable between said second massaging member means and said second cam means, whereby a movement of said second cam means effects a concurrent movement of said second lifter bar means and said second massaging member means.

6. The massage table as defined in claim 4, wherein said first lifter bar means includes first and second lifter bars and said first cam means includes at least first and second cams in respective abutting relationships with said first and second lifter bars.

7. The massage table as defined in claim 6, wherein said first and second cams are fixedly secured to a common rotatable shaft.

8. The massage table as defined in claim 7, wherein said first massaging member means includes first and second lift rods guidingly positioned into an abutting relationship with said first and second lifter bars respectively, and further includes massaging members fixedly secured to topmost portions of said first and second lift rods.

9. The massage table as defined in claim 5, wherein said second lifter bar means includes at least one lifter bar associated with at least one cam forming a portion of said second cam means.

* * * * *